US005435149A

United States Patent [19]

Strong et al.

[11] Patent Number: 5,435,149

[45] Date of Patent: Jul. 25, 1995

[54] REFRIGERATION SYSTEM

[75] Inventors: John R. Strong; Gary W. Luhm, both of Kirkland; Roger P. Crasic, Issaqmah; Jon A. Hocker, Kirkland, all of Wash.

[73] Assignee: Frigoscandia Equipment Aktiebolag, Helsingborg, Sweden

[21] Appl. No.: 234,372

[22] Filed: Apr. 28, 1994

[51] Int. Cl.[6] ..... F25B 41/04

[52] U.S. Cl. ..... 62/218; 62/116; 62/503

[58] Field of Search ..... 62/218, 116, 219, 220, 62/221, 217, 174, 500, 503, 509

[56] References Cited

U.S. PATENT DOCUMENTS

| | | | |
|---|---|---|---|
| 2,132,932 | 10/1938 | Boileau et al. | 62/218 X |
| 2,156,426 | 5/1939 | Brown et al. | 62/218 X |
| 2,278,003 | 3/1942 | Thompson | 62/218 X |
| 2,813,404 | 11/1957 | Hirsch et al. | 62/115 |
| 2,859,596 | 11/1953 | Evans | 62/471 |
| 3,670,519 | 6/1972 | Newton | 62/116 |
| 4,142,380 | 3/1979 | Dyhr et al. | 62/471 |
| 4,159,735 | 7/1979 | Anderson | 62/218 X |
| 4,187,695 | 2/1980 | Schumacher | 62/503 |
| 5,343,711 | 9/1994 | Kornhauser et al. | 62/116 |

FOREIGN PATENT DOCUMENTS

| | | |
|---|---|---|
| 0438251 | 7/1991 | European Pat. Off. . |
| 705684 | 5/1941 | Germany . |
| 445256 | 6/1982 | Sweden . |

*Primary Examiner*—Harry B. Tanner
*Attorney, Agent, or Firm*—Browdy and Neimark

[57] ABSTRACT

A refrigeration system comprises an evaporator overfed with liquid refrigerant and discharging a mixture of vapor refrigerant and liquid refrigerant; a compressor for compressing vapor refrigerant discharged from the evaporator; a condenser receiving compressed vapor refrigerant from the compressor for transforming it into liquid refrigerant; and a receiver receiving the liquid refrigerant from the condenser and supplying it to the evaporator. A separator receiving the refrigerant discharged from the evaporator separates the-vapor refrigerant for the compressor from the liquid refrigerant for recirculation. A feeder stores the pressurized liquid refrigerant and overfeeds the evaporator therewith. An educer feeds liquid refrigerant from the separator to the feeder using liquid refrigerant from the receiver as pressurizing agent.

10 Claims, 2 Drawing Sheets

REFRIGERATION SYSTEM

BACKGROUND OF THE INVENTION

This invention relates to refrigeration systems of the overfeed type and particularly relates to ammonia refrigeration systems in low-temperature applications.

Especially, it relates to a refrigeration system having an evaporator overfed with liquid refrigerant and discharging a mixture of vapor refrigerant and liquid refrigerant; a compressor for compressing vapor refrigerant discharged from the evaporator; a condenser receiving compressed vapor refrigerant from the compressor for transforming it into liquid refrigerant; and a receiver receiving the liquid refrigerant from the condenser and supplying it to the evaporator.

Industrial refrigeration systems, particularly low-temperature, e.g. below −35° F., high-capacity, e.g. greater than 25 TR, systems, are often overfeed type systems. In order to maximize the effectiveness of the evaporator in such refrigeration systems, its entire inner surface should be covered with liquid refrigerant, i.e. wetted. To wet the entire surface, excess liquid refrigerant of at least three times, preferably four times, that which is evaporated, must be fed into the evaporator. In addition, the refrigerant liquid fed into the evaporator should be at the sane temperature as the evaporator.

In typical refrigeration systems, the liquid refrigerant is flashed to evaporating temperature in a large vessel. After dropping to evaporating temperature, the refrigerant liquid is driven into the evaporator by one of several means. Mechanical pumps are used when the vessel is located remote from the evaporator. Mounting the vessel near the evaporator and above it allows gravity head to pressurize the cold liquid refrigerant and drive it through the evaporator.

Both of the above methods of driving the refrigerant through the evaporator require a large storage vessel to provide a pressure head for the mechanical pump or to provide a certain gravity head. Also, in each of these designs, there is a vertical lift in the pipe leaving the evaporator and/or horizontal pipe runs with two phase flow. The pressure drop is much greater in pipes with two phase flow than in those with a flow of only dry vapor. Excessive pressure drop results in higher operating costs and the need for larger compressors, mains, and vessels, raising the initial costs of the system. The large vessels required for these types of systems also require that the system be charged with a large amount of refrigerant.

SUMMARY OF THE INVENTION

A main object of the present invention is to provide a means for driving the liquid refrigerant through the evaporator such that no large vessel for the liquid refrigerant is required directly on the feed side of the evaporator.

Another object of the present invention is to eliminate mechanical pumps or gravity head as means for driving the liquid refrigerant.

Still another object of the present invention is to provide a means for continuously driving the liquid refrigerant through the evaporator.

Yet another object of the present invention is to obtain a dry suction supply from the evaporator back to the compressor.

These and other objects of the present invention are attained by a combination comprising a separator receiving the refrigerant discharged from the evaporator for separating vapor refrigerant for the compressor from liquid refrigerant for recirculation; a feeder for storage rage of pressurized liquid refrigerant and overfeeding the evaporator therewith; an educer for feeding said liquid refrigerant for recirculation from the separator to the feeder using liquid refrigerant from the receiver as pressurizing agent.

Preferably, a pipe connects the receiver .to the feeder for supply of makeup liquid refrigerant.

Thus, a refrigeration system utilizing the present invention does not use mechanical pumps or gravity head or even batch-type vapor pumps. Also, the invention provides separation of the liquid refrigerant leaving the evaporator such that only dry vapor is fed back to the compressor, thereby reducing the pressure drop. Further, the present invention provides for control of the flow rate of the liquid refrigerant to the evaporator by controlling the pressure in the feeder. Alternatively, the flow rate of liquid from the feeder to the evaporator may be regulated by controlling the flow rate from the receiver to a recirculator comprising the feeder, the separator, and the educer.

DESCRIPTION OF THE PREFERRED EMBODIMENT

Figure 1:
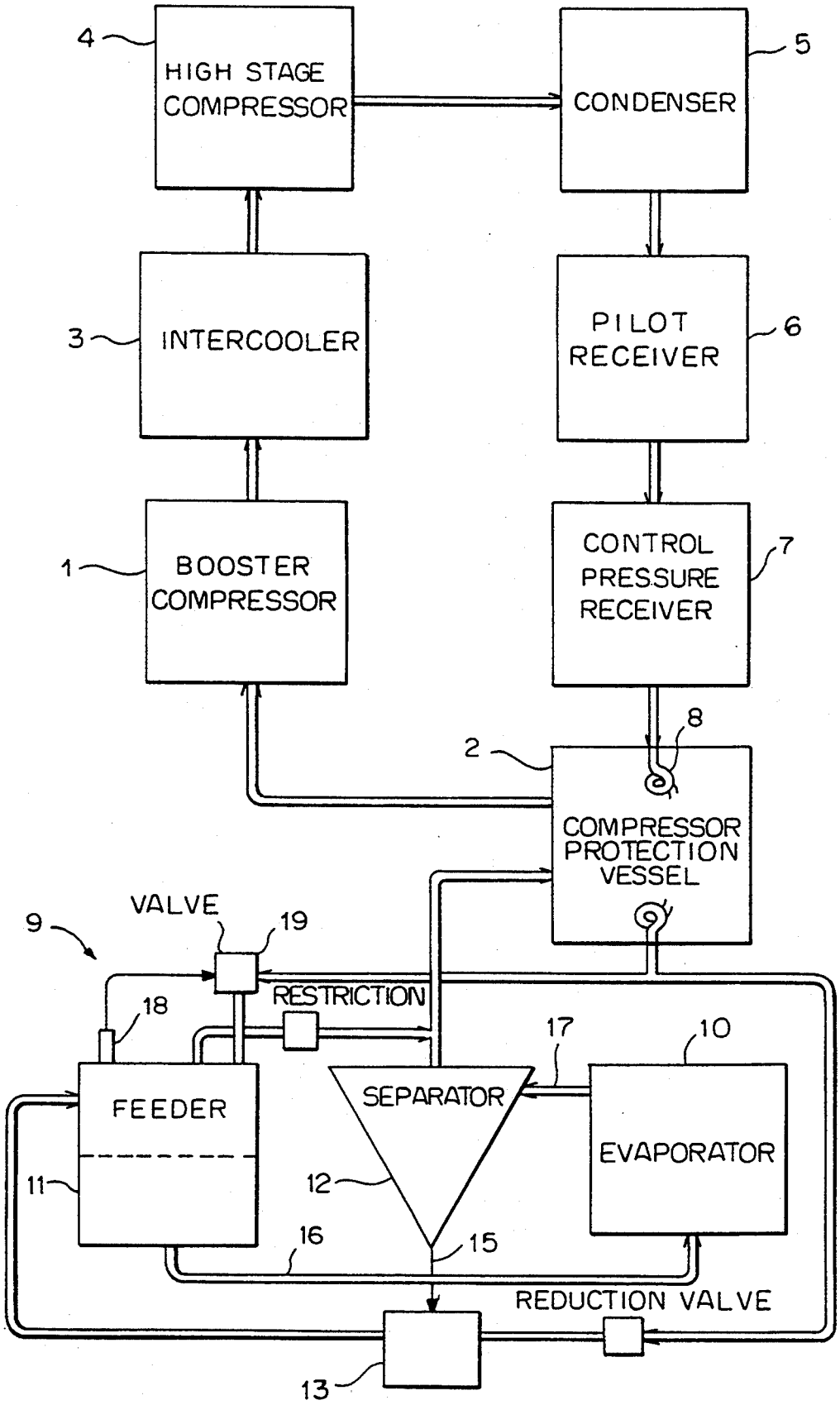
FIG. 1 is a schematic diagram of a typical refrigeration system employing the present invention.
Figure 2:
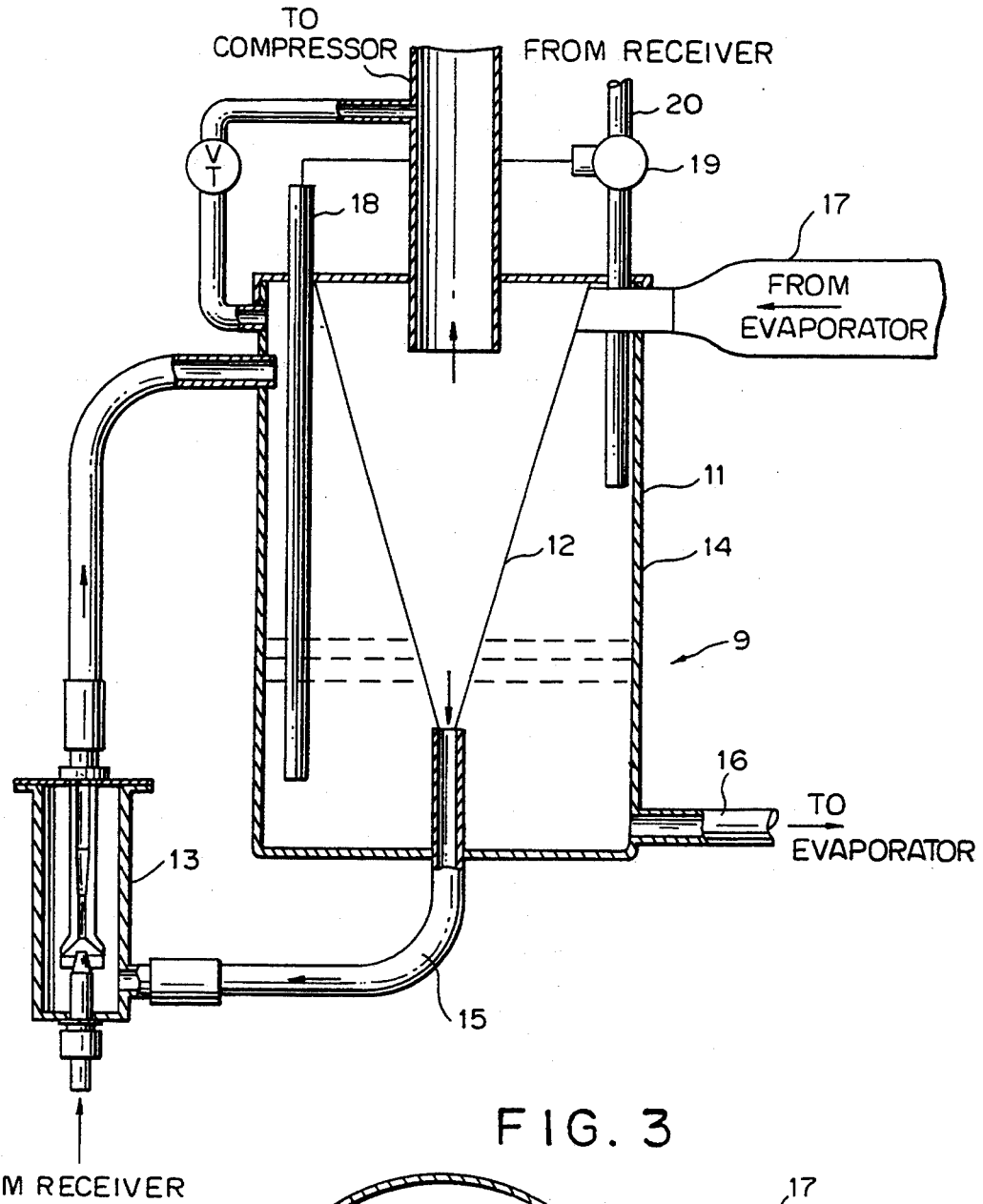
FIG. 2 is an elevational view of one embodiment of a recirculator according to the present invention.
Figure 3:
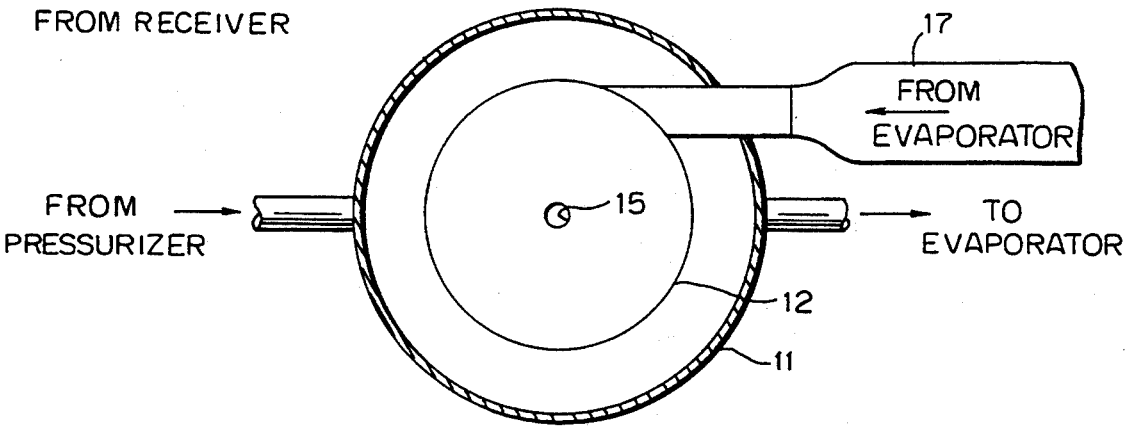
FIG. 3 is a plan view of the recirculator in FIG. 2.

The refrigeration system schematically illustrated in FIG. 1 comprises a booster compressor 1 that draws refrigerant vapor from a compressor protection vessel 2, and discharges compressed vapor into an intercooler 3, where the vapor is cooled before being further compressed by a high-stage compressor 4. The vapor compressed by the compressor 4 is discharged to an evaporative condenser 5 where heat is removed. The vapor is thereby transformed into a liquid that drains to a pilot receiver 6. This receiver 6 may provide liquid for oil cooling.

From the pilot receiver 6, liquid refrigerant is also fed through a control pressure receiver 7 and a subcooling coil 8 in the compressor protection vessel 2 to a recirculator 9 according to the present invention. In the recirculator 9, the liquid refrigerant is flashed to evaporating temperature and pressurized before it is fed to an evaporator 10.

In the above-described refrigeration system, the compressors 1 and 4, the condenser 5, the receivers 6 and 7, the intercooler 3, the compressor protection vessel 2, and the evaporator 10 are well-known components of a typical refrigeration system.

The recirculator 9 comprises three units, viz. a feeder 11, a separator 12, and an educer 13. In the preferred embodiment, the feeder 11 and the separator 12 are integrated in a single cylindrical housing 14 but they could be separate units. The feeder 11 represents a high-pressure section, and the separator 12 represents a low-pressure section.

The integrated recirculator 9 is comprised of the cylindrical housing 14 functioning as a pressurized refrigerant storage enabling continuous overfeeding of only liquid refrigerant into the evaporator 10. The integrated recirculator 9 also comprises the conically-shaped separator 12 disposed within the housing 14.

The bottom of the conical separator 12 includes an outlet 15 which is in fluid communication with the educer 13. A refrigerant outlet line 16 connects the bottom of the housing 14 with the evaporator 10. The mixture of vapor refrigerant and liquid refrigerant from the evaporator 10 is tangentially discharged into the top of the conical separator 11 through an inlet 17. This imposes a centrifugal action on the mixture. As a result, the heavier liquid refrigerant is effectively separated from the vapor refrigerant with the liquid retigerant flowing to the bottom or vertex of the conical separator 12 and into the educer 13. The dry vapor is drawn off through a top base outlet and recycled to the compressor 1 via the compressor protection vessel 2.

A control system comprising a level detector 18, e.g. a capacitance probe, and a control valve 19, e.g. a characterized ball valve, in a pipe 20 connecting the receiver 7 to the feeder 11, maintains the level of liquid refrigerant in the feeder 11 between predetermined upper and lower level limits.

The system operates as follows.

Liquid refrigerant drops from the condenser 5 to the pilot receiver 6 where a portion of the liquid held to cool the oil in the compressors. The liquid that leaves the pilot receiver 6 is fed into the control pressure receiver 7 for storage until called for by the capacitance probe 18 in the recirculator 9. The liquid refrigerant then passes through the coil 8 in the compressor protection vessel 2, where it is subcooled to minimize the formation of vapor before it flows through the characterized ball valve 19 that preferably is modulated open an amount inversely proportional to the depth of liquid in the feeder 11 of the recirculator 9, and into the feeder 11.

A volume of liquid refrigerant equal to the amount required to meet the freezer's base load is fed from the receiver to the educer 13. As the liquid flows through the educer 13, it creates a low-pressure area and draws out the liquid refrigerant that is standing in the lower part of the separator 12. The liquid from the separator 12, the liquid required for the base load, and flash vapor together pass into the storage section 11 filling it as well as providing an overpressure therein. This overpressure pushes the liquid refrigerant into the evaporator 10, where it gains heat up to boiling, thus forming vapor. The excess liquid refrigerant fed into the evaporator 10 to ensure that its entire inner Surface is coated with liquid, moves with the vapor refrigerant into the funnel-shaped separator 12 where the vapor refrigerant is separated from the liquid refrigerant and fed back to the compressor 1 via the compressor protection vessel 2.

The system described above functions in a novel manner to circulate and recirculate liquid refrigerant through an evaporator, without the inclusion of any vapors or flash gas in the refrigerant.

Further, the system does not use gravity head or mechanical pumps but provides separation of all liquid refrigerant from vapor refrigerant recycling to the compressor.

The inventive system also provides a minimum pressure drop, allows the amount of excess liquid refrigerant fed into the evaporator to be adjusted, and reduces the amount of refrigerant in a typical system. This reduction is a result of the pressurized feeder and the control of the liquid refrigerant level therein.

By enclosing the cyclone-type separator 12 in the pressure housing of the feeder 11, the need to make the separator strong enough to pass various pressure vessel codes is eliminated. Further, the entire recirculator 9 may fit inside a freezer so that the piping can be completed prior to shipping. Of course, the system according to the invention may also be very small in size such that it does not increase the outside dimensions of the freezer. Still, the inventive system will be able to circulate a sufficient quantity of liquid refrigerant without being located higher than the evaporator.

It should be noted that the pumping fluid of the educer, i.e. the liquid refrigerant from the receiver 7, is at a higher temperature than its boiling point at the outlet pressure. Thus, as soon as the liquid passes the minimum diameter of the nozzle, the liquid flashes off a volume of vapor equal to many times the volume of liquid. This flashed vapor presents an opportunity, if the nozzle is built as a first converging and then diverging nozzle of correct dimensions. In this case, the vapor flashing can be used to accelerate the mixture of liquid and vapor refrigerant to an even higher velocity maintaining the higher pressure within the feeder 11.

The refrigeration system as described is adapted for use in industrial refrigeration systems. In particular, the system is designed to operate at low operating temperatures utilizing ammonia as refrigerant.

It is to be understood that modifications, alterations and changes can be made in the system without departing from the scope of the invention as claimed herein. Thus, it is intended that the above description and the accompanying drawings shall be interpreted as illustrative and not in a limitative sense.

What is claimed is:

1. In a refrigeration system having an evaporator overfed with liquid refrigerant and discharging a mixture of vapor refrigerant and liquid refrigerant;

a compressor for compressing vapor refrigerant discharged from the evaporator;

a condenser receiving compressed vapor refrigerant from the compressor for transforming it into liquid refrigerant;

a receiver receiving the liquid refrigerant from the condenser and supplying it to the evaporator;

the combination comprising a separator receiving the refrigerant discharged from the evaporator for separating vapor refrigerant for the compressor from liquid refrigerant for recirculation;

a feeder for storage of pressurized liquid refrigerant and overfeeding the evaporator therewith; and an educer for feeding said liquid refrigerant for recirculation from the separator to the feeder using liquid refrigerant from the receiver as pressurizing agent.

2. A refrigeration system as claimed in claim 1, comprising a pipe connecting the receiver to an inlet of the feeder for supply of makeup liquid refrigerant.

3. A refrigeration system as claimed in claim 1, wherein the receiver continuously supplies liquid refrigerant to the educer as pressurizing agent.

4. A refrigeration system as claimed in claim 1, wherein the feeder has an outlet for vapor refrigerant connected to an outlet of the separator.

5. A refrigeration system as claimed in claim 4, wherein a pressure regulation valve in said outlet of the feeder controls the overpressure in the feeder.

6. A refrigeration system as claimed in claim 2, comprising a detector for detecting the level of liquid refrigerant in the feeder, and a valve in said pipe responsive to said level detected by the detector for controlling the supply of makeup refrigerant.

7. A refrigeration system as claimed in claim 6, wherein the level detector is a capacitance probe and the valve is a characterized ball valve.

8. A refrigeration system as claimed in claim 1, wherein the educer is supplied with liquid refrigerant from the receiver and draws liquid refrigerant from the separator into the feeder maintaining the pressure therein.

9. A refrigeration system as claimed in claim 1, wherein the separator is contained within the feeder.

10. A refrigeration system as claimed in claim 9, wherein the separator is conical having a bottom vertex outlet for liquid refrigerant to the educer, a top base outlet for vapor refrigerant to the compressor, and a top tangential inlet for refrigerant from the evaporator.

* * * * *

UNITED STATES PATENT AND TRADEMARK OFFICE

CERTIFICATE OF CORRECTION

PATENT NO. : 5,435,149

DATED : July 25, 1995

INVENTOR(S) : John R. STRONG et al.

It is certified that error appears in the above-indentified patent and that said Letters Patent is hereby corrected as shown below:

Title page, column 1, item 75 (Inventors), please change "Roger P. Crasic" to --Roger P. Crask--.

Signed and Sealed this

Twelfth Day of December, 1995

*Attest:*

BRUCE LEHMAN

*Attesting Officer*

*Commissioner of Patents and Trademarks*